United States Patent [19]

Vanderford, Jr.

[11] Patent Number: 4,790,379

[45] Date of Patent: Dec. 13, 1988

[54] WELLHEAD HANGER

[75] Inventor: Delbert E. Vanderford, Jr., Cypress, Tex.

[73] Assignee: Cameron Iron Works USA, Inc., Houston, Tex.

[21] Appl. No.: 116,774

[22] Filed: Nov. 5, 1987

[51] Int. Cl.[4] ..... F21B 19/10; F16L 21/00

[52] U.S. Cl. ..... 166/208; 285/146

[58] Field of Search ..... 166/85, 96, 208; 285/144, 145, 146, 147, 148; 175/423

[56] References Cited

U.S. PATENT DOCUMENTS

| | | | |
|---|---|---|---|
| 2,553,838 | 5/1951 | Allen et al. | 285/146 |
| 2,582,700 | 1/1952 | Jones . | |
| 2,920,909 | 1/1960 | Allen | 285/146 |
| 3,311,168 | 3/1967 | Pierce, Jr. | 166/89 |
| 4,152,015 | 5/1979 | Jones et al. | 285/146 |
| 4,390,186 | 6/1983 | McGee et al. | 277/236 |
| 4,494,778 | 1/1985 | Johnson | 285/146 |
| 4,678,209 | 7/1987 | Guice | 285/178 X |

*Primary Examiner*—Jerome W. Massie, IV
*Assistant Examiner*—William P. Neuder
*Attorney, Agent, or Firm*—Vinson & Elkins

[57] ABSTRACT

The hanger apparatus includes a segmented bowl structure which includes inner tapered surfaces which are adapted to coact with the outer surfaces of the slips supported on the bowl segments and a lower outer tapered seat which is adapted to engage a shoulder within the well structure. A packing structure is connected to the upper end of the bowl segments and includes an upper plate ring, a lower seat ring having a lower outer seating surface, and a resilient packing ring positioned between the upper plate ring and the lower seat ring. Cap screws engage upper plate ring and extend through the packing ring and the seat ring and are threaded into the bowl segments. The upper plate ring moves downward with the initial downward movement of the bowl segments during setting to compress the packing ring into sealing engagement between the exterior of the string and the interior of the wellhead housing. The exterior of the slips in one form of the invention include a plurality of compound tapers which coact with the bowl tapers. The lower taper of each section of the slip tapers is at a very slight angle with respect to the axis of the unit and the upper taper of each section of the slip tapers is at a substantially greater angle to the axis of the unit than that of the lower taper. In another form of the invention the slight angle taper is limited to the lower portion of the slip camming surfaces and is engaged by a finger supported from the lower portion of the bowl segments.

6 Claims, 4 Drawing Sheets

WELLHEAD HANGER

BACKGROUND

The support of well strings within a wellhead generally has utilized gripping elements or slips supported on a bowl which tapers downwardly and inwardly so that as the slips engage the string and assume the weight they are pulled downward on the bowl taper and caused to move into tighter engagement with the string.

A problem which has been encountered with such hangers, particularly when they are supporting heavy strings of high strength casing, is that the weight is sufficient to cause undue inward force on the string which is sufficient to cause deformation of the portion being gripped by the slips beyond the normal engagement of the slip teeth into the exterior of the string.

An example of a prior art device which attempts to solve this problem is the U.S. Pat. No. 2,920,909. This patent discloses a hanging device which includes a slip bowl having a lower inner taper which is at a slight angle to the axis of the unit and an upper taper at a substantial angle to the axis of the unit. Slips are supported in the lower taper and connecting means engage the lower slips, extend through openings in the bowl, through a packer on the upper bowl surface and through the upper slips which are supported by the packer. The unit is designed to avoid severe deformation of the string due to heavy loading. As the lower slips assume the string weight they move downwardly into tighter engagement with the string and also pull the upper slips downwardly causing the packer to be set and thereafter moving the upper slips inwardly against the string to share in the load.

Difficulty is encountered in the use of such units, particularly where higher mud temperatures are encountered, in that the packer is heated and tends to extrude. The failure of the packer is an unacceptable condition to present day drilling operations.

Prior patents have disclosed slip structures in which multiple camming surfaces are provided on the bowl and on the backs of the slips with all of the surfaces being at the same angle to the axis of the unit. Examples of such structures are disclosed in U.S. Pat. Nos. 2,582,700; 3,311,168, 4,390,186 and 4,494,778.

None of these prior art structures has solved the problem of supporting the progressively heavier strings without creating unacceptable deformation of the string.

SUMMARY

The present invention relates to a wellhead hanger apparatus which supports heavier strings within a well bore without creating unacceptable deformation of the string being supported. The hanger apparatus includes a segmented bowl structure which includes inner tapered surfaces which are adapted to coact with the outer surfaces of the slips supported on the bowl segments and a lower outer tapered seat which is adapted to engage a shoulder within the well structure. A packing structure is connected to the upper end of the bowl segments and includes an upper plate ring, a lower seat ring having a lower outer seating surface and a resilient packing ring positioned between the upper plate ring and the lower seat ring. The connection between the bowl segments and the packing structure is to the upper plate ring which moves downward with the initial downward movement of the bowl segments during setting to compress the packing ring into sealing engagement between the exterior of the string and the interior of the wellhead housing. The exterior of the slips include a plurality of compound tapers which coact with the bowl tapers. The lower taper of each section of the slip tapers is at a very slight angle with respect to the axis of the unit and the upper taper of each section of the slip tapers is at a substantially greater angle to the axis of the unit that the lower taper.

An object of the present invention is to provide an improved hanger apparatus which will support heavy strings within a wellhead housing without creating unacceptable deformation to the string being supported.

Another object is to provide an improved hanger apparatus which supports heavy strings and includes a packer which is not overstressed or extruded by excessive loads resulting from the supported weight of the string.

A further object is to provide an improved hanger having slips which ensure positive initial engagement with a string and do not create unacceptable crushing engagement of the slips with the string when supporting a heavy string.

BRIEF DESCRIPTION OF THE DRAWINGS

These and other objects and advantages of the present invention are hereinafter set forth and explained with respect to the drawings wherein.

DESCRIPTION OF THE PREFERRED EMBODIMENTS

Figure 1:
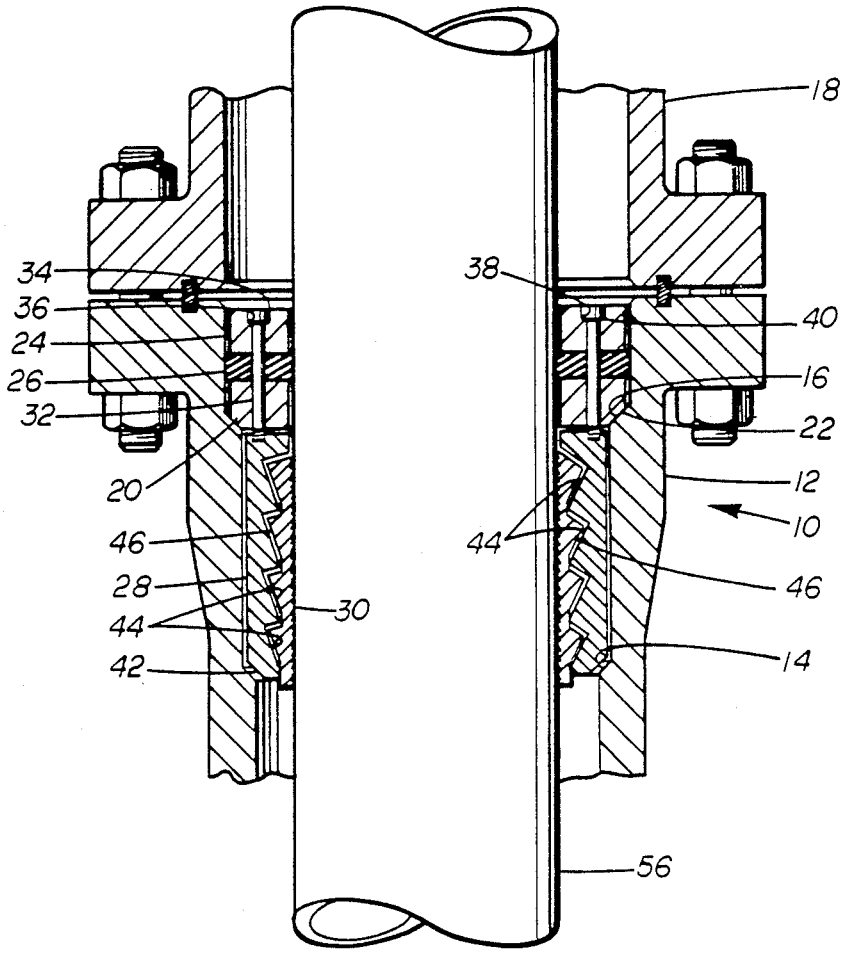
FIG. 1 is a sectional view of the improved hanger of the present invention positioned within a wellhead housing in surrounding relation to a string and landed on the upper housing seat.

Wellhead hanger assembly 10 is shown in the drawings as being positioned within wellhead housing 12. Wellhead housing 12 includes lower upwardly facing seat 14 and upper upwardly facing seat 16 on which assembly 10 is landed and with which it coacts in being energized to its set position. Tubular member 18 is connected above housing 12 by studs and nuts securing their respective flanges together in the known manner.

Wellhead hanger assembly 10 includes segmented seat ring 20 having lower downwardly facing outer shoulder 22 which is seated on seat 16 within housing 12, upper segmented ring 24 with resilient sealing means, such as segmented sealing ring 26 positioned between segmented rings 20 and 24, lower cam or bowl segments 28 and slips 30. Bowl segments 28 are supported below rings 20 and 24 by cap screws 32 which extend downwardly through bores 34 through rings 20 and 24 and sealing ring 26 and thread into bowl segments 28. Counterbores 36 into upper ring 20 provide shoulders 38 against which heads 40 of cap screws 32 engage. The lower end of bowl segments 28 include outer downwardly facing seats 42 which as hereinafter described engage lower seat 14 on housing 12. Bowl segments 28 also include a plurality of internal cam surfaces 44 which coact with external cam surfaces 46 on slips 30. While not shown it is understood that hanger assembly 10 is constructed as is well known in the prior art to be in separate segments and to include some type of connecting means and some type of lifting means so that they may be installed around a string and then lowered into position within wellhead housing 12 to the position shown in FIG. 1.

Figure 2:
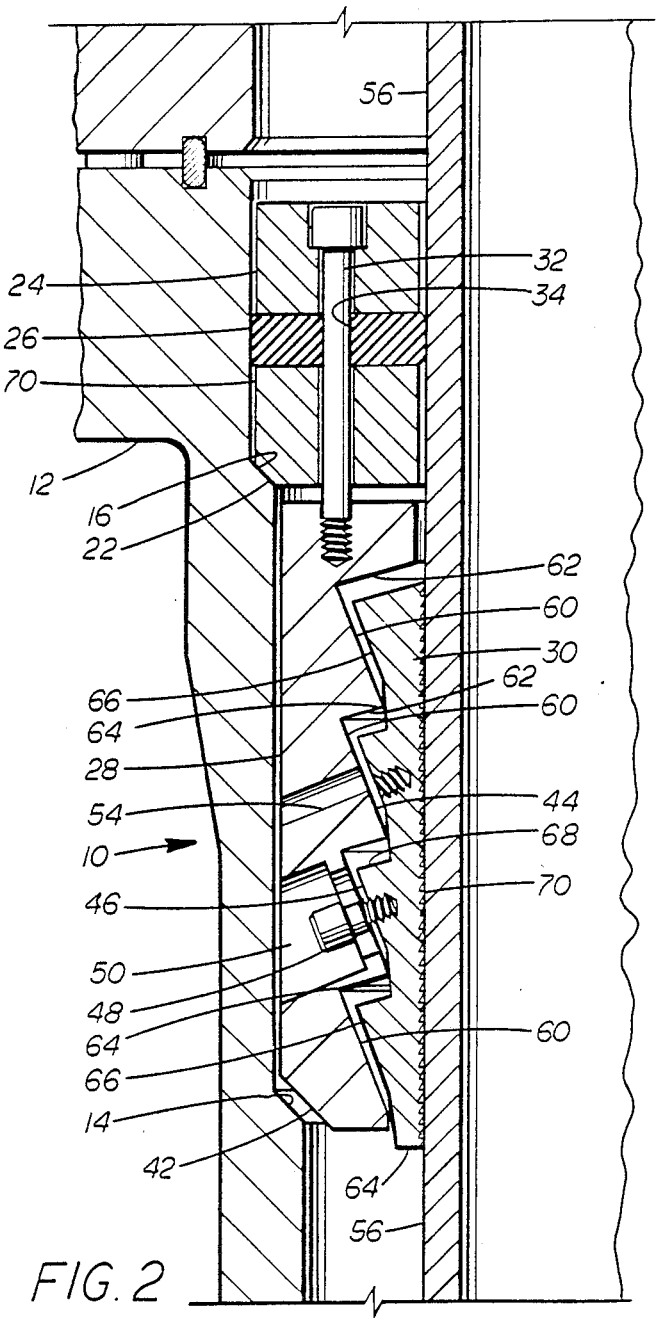
FIG. 2 is a partial sectional view of the improved hanger illustrating the initial movement of the slips into gripping engagement with the string.

As shown in FIG. 2, slips 30 are retained within bowl segments 28 by cap screws 48 extending through vertical slots 50 in bowl segments 28 and threaded into the exterior of slips 30. Also, cap screws (not shown) extend through bores 54 in bowl segments 28 and thread into slips 30 to retain slips 30 in their upper position until hanger assembly 10 is positioned around a string 56 which is to be supported thereby within housing 12.

Cam surfaces 44 on bowl segments 28 include a series of tapered surfaces 60 which taper downwardly and inwardly at a shallow angle, for example 20 degrees with respect to the axis of string 56, and shoulder surfaces 62 at the upper end of each of surfaces 60 extending upwardly and inwardly to intersect the lower end of surface 60 immediately above. The exterior cam surfaces 46 of slips 30 include multiple tapered surfaces with lower tapered surface 64 tapering upwardly and outwardly at a slight angle with respect to the axis of string 56, upper tapered surface 66 tapering upwardly and outwardly at an angle substantially greater than that of surface 64 and also mating with the taper on surfaces 60 and shoulders 68 which taper inwardly and upwardly to connect the upper portion of surface 66 to the lower portion of surface 64 as best shown in FIG. 2. Gripping teeth 70 are provided on the interior of slips 30 to provide gripping engagement between slips 30 and the exterior of string 56 as hereinafter described.

Wellhead hanger assembly 10 is used to support string 56 within housing 12 and is installed in position around string 56 with suitable links (not shown) being secured to their opposite segments and cap screws (not shown) being thereafter removed to release slips 30 and then assembly 10 is lowered in surrounding relationship to string 56. During this installation, string 56 is supported from above tubular member 18. Gripping teeth 70 are angled in the normal manner so that they generally face upwardly allowing slips 30 to slide downwardly over the exterior of string 56 but engage string 56 when it tends to move downwardly within slips 30.

Figure 3:
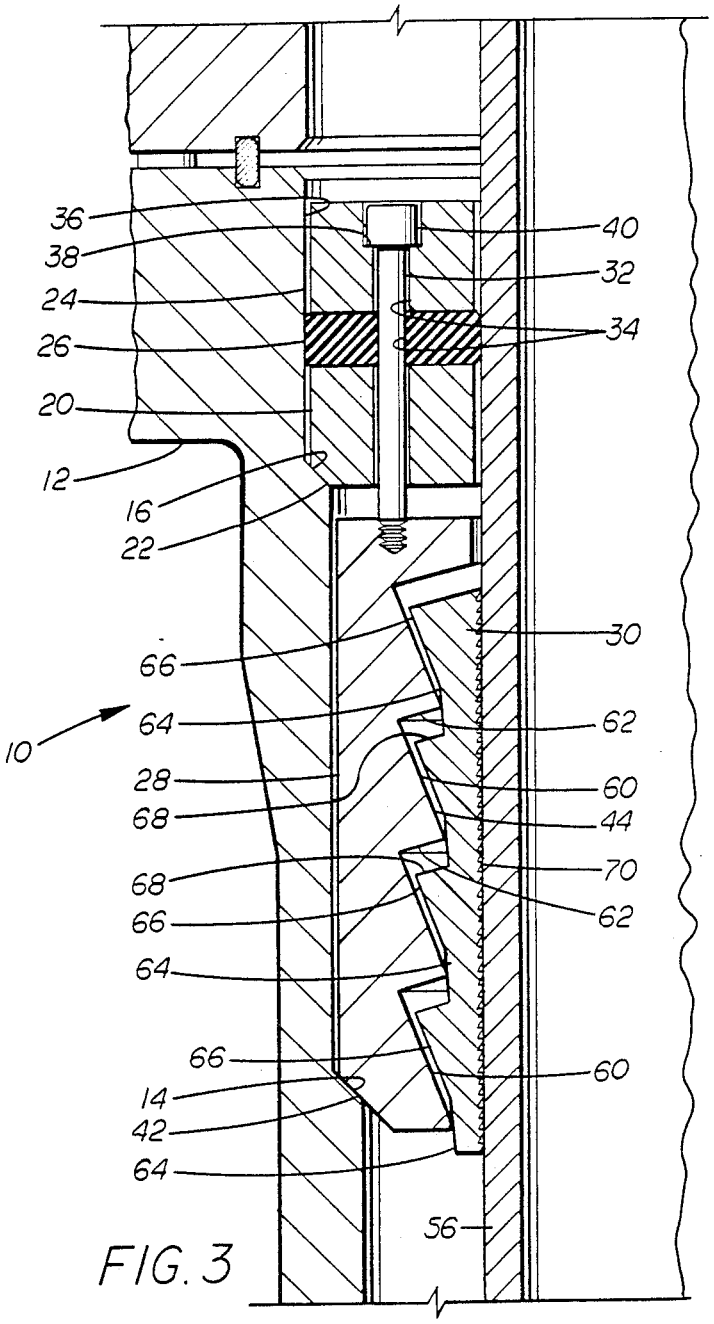
FIG. 3 is another partial sectional view of the improved hanger showing the seating of the slip bowl segments on the lower housing seat with the hanger packer set.

After assembly 10 reaches the position in which shoulder 22 on segmented ring 20 engages upper seat 16 on housing 12 (shown in FIG. 2), the support of string 56 is relaxed allowing string 56 to move downwardly slightly to thereby bring slips 30 into gripping engagement with the exterior of string 56. This causes slips 30 and bowl segments 28 to move downward until lower seat 42 on bowl segments 28 engages lower seat 14 within housing 12. This downward movement of bowl segments 28 by virtue of the connection to upper ring 24 by cap screws 32 causes upper ring 24 to move downward to compress sealing ring 26 between the lower surface of upper ring 24 and the upper surface of seat ring 20 so that sealing ring 26 moves radially outward into sealing engagement between the exterior of string 56 and the interior of housing 12. Also, sealing ring 26 being in segments seals between segments as a result of such compression. Further downward movement of string 56 causes slips 30 to move downward with respect to bowl segments 28 and to thereby move the lower inner end of surfaces 60 of bowl segments 28 upward with respect to cam surface 64 on the exterior of slips 30. This causes slips 30 to be wedge into tighter gripping engagement with the exterior of string 56. This position is illustrated in FIG. 3.

Figure 4:
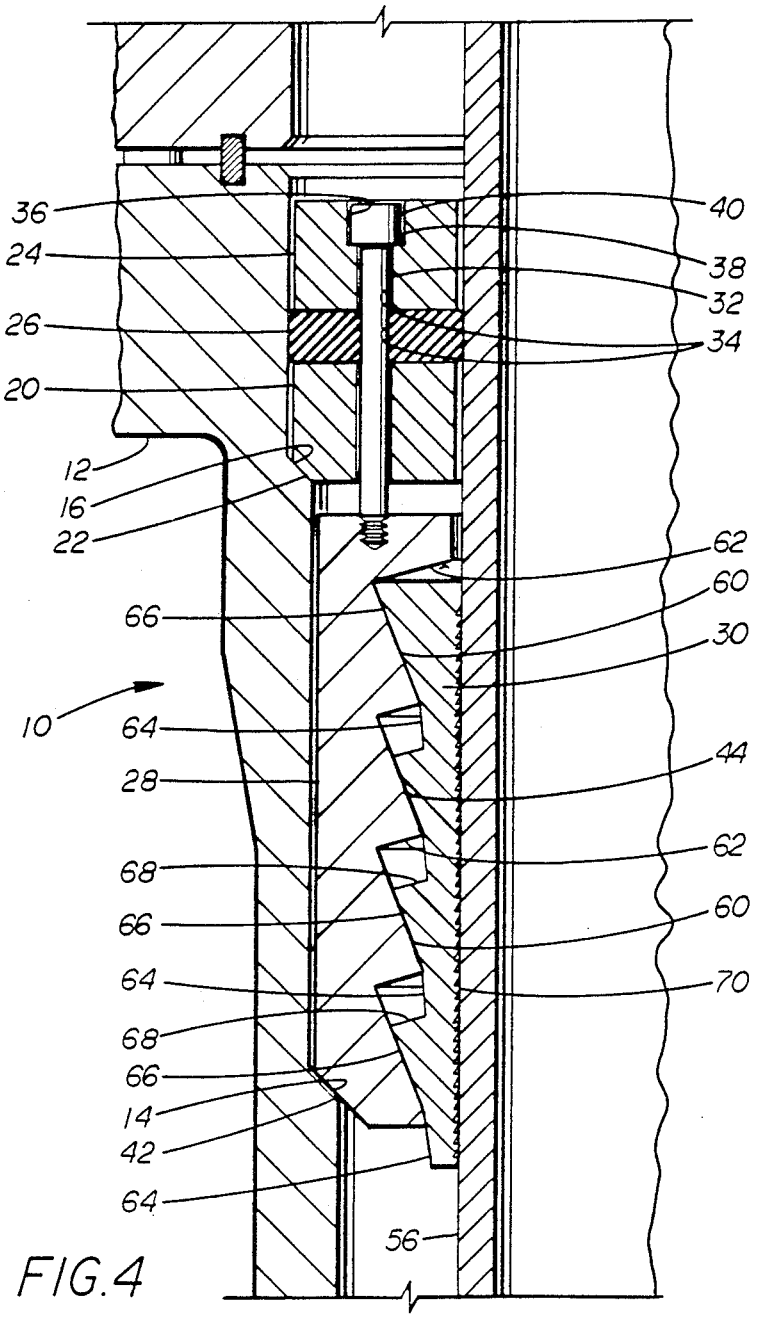
FIG. 4 is another partial sectional view of the improved hanger showing the further downward movement of the slips onto the second section of camming surfaces to support the string and limit the inward force created in assuming the weight.

As additional support for string 56 is relaxed, it exerts further weight on slips 30 causing them to move downward to the position shown in FIG. 4 in which surfaces 60 on the interior of bowl segments 28 are in engagement with surfaces 66 on the exterior of slips 30. These surfaces are tapered at a substantially greater angle than surfaces 64 and thus provide the necessary support for string 56 after teeth 70 of slips 30 have been securely set into gripping engagement with string 56 responsive to the wedging action provided by bowl segments 28 engaging lower camming surfaces 64. In this position, the support for string 56 can be completely relaxed and wellhead hanger assembly 10 will provide the necessary support to maintain string 56 in its position with respect to housing 12.

Wellhead hanger assembly 10 is easily removed by raising string 56. The gripping engagement of slips 30 with string 56 allows assembly 10 to be raised through tubular member 18 and removed. Also, some provision can be made to lower a suitable tool in surrounding relationship to string 56 and to engage hanger assembly 10 to lift it after its support of string 56 has been released. When assembly 10 has been raised sufficiently to allow direct access to the connecting structure (not shown), assembly 10 can be separated into its two segments and removed from surrounding relationship to string 56.

Figure 5:
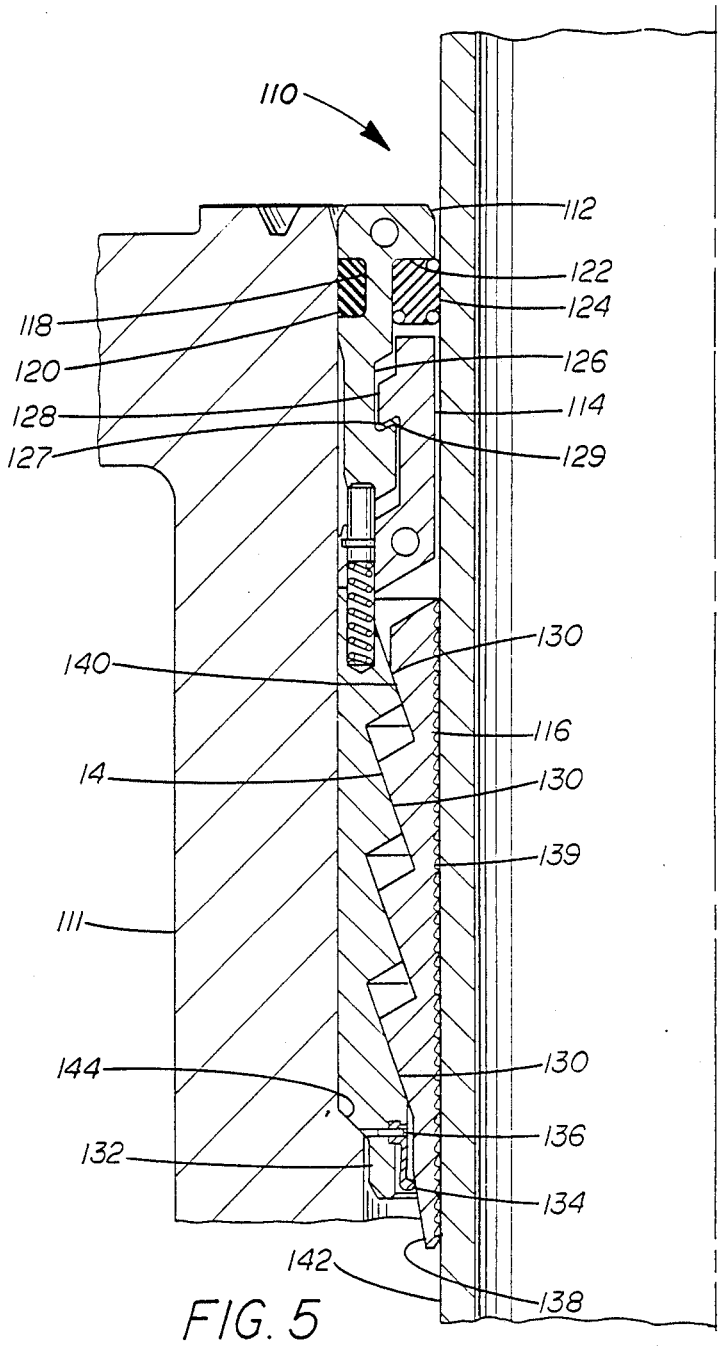
FIG. 5 is a sectional view of a modified form of the improved hanger within a wellhead housing showing the slips in gripping engagement with the string.

Wellhead hanger assembly 110 as shown in FIG. 5 positioned within wellhead housing 111 is a modified form of the present invention and includes sealing segments 112 which when assembled form a sealing ring, bowl segments 114, which when assembled form a bowl, and slips 116 which are mounted in the usual manner to bowl segments 114. Sealing segments 112 include outer groove 118 in which outer resilient sealing ring 120 is positioned and downwardly facing inner shoulder 122 against which inner resilient sealing ring 124 is positioned. The lower surface of sealing ring 124 is spaced above the upper surface of bowl segments 114 as shown. Also, sealing segments 112 include inner groove 126 which has a lower shoulder 127 tapering upwardly and inwardly. Projection 128 which extends from the upper exterior surface of bowl segments 114 is positioned within groove 126 and has its lower surface 129 tapered upwardly and inwardly as a mating taper to the lower surface 127 of groove 126. The interior of bowl segments 114 include a plurality of camming surfaces 130 extending downwardly and inwardly at the same angle with skirt 132 depending from the lower end of bowl segments 114. Spring fingers 134 are secured to bowl segment skirt 132 by pins 136 which are press fitted into skirt 132 and are positioned to engage lower outer tapered surface 138 on slips 116. The taper on surface 138 is at a smaller angle with respect to the axis of assembly 10 than the taper of camming surfaces 130. Slips 116 include inner gripping teeth 139 and mating camming surfaces 140 which are adapted to come into engagement with camming surfaces 130 after fingers 134 have caused slips 116 by their engagement with surface 138 to tightly grip string 142. This initial shallow tapered surface 138 and its engagement by fingers 134 is sufficient to set slips 116 against the exterior of string 142 so that there is sufficient gripping engagement to support string when camming surfaces 130 and 140 come into engagement and assume the transmittal of the load of string 142 to seating shoulder 144 of housing 111 and add further loading on slips 116 inwardly against string 142.

As can be seen from the modified form of the invention shown in FIG. 5, it includes the shallow taper, with respect to the axis of assembly 110, which taper is used to exert high initial loading force on the slips 116 to ensure their tight gripping engagement with the exterior of string 142 and the steeper taper, with respect to the axis of assembly 110, used to transmit the load to seating shoulder 144 of housing 111. Sealing rings 120 and 124 are provided with sufficient thickness with respect to the depth of groove 118 and shoulder 122 to ensure that they come into tight sealing engagement with the interior of housing 111 and the exterior of string 142. Fingers 134 are sufficiently resilient to ensure that their engagement with surface 138 cause gripping teeth 139 on slips 116 to move into initial gripping engagement with string 142 but not to create such force as would substantially resist relative movement of slips 116 and bowl segments 114.

What is claimed is:

1. A wellhead hanger comprising a segmented bowl structure having a plurality of segments, means for connecting said bowl segments into a bowl ring, each of said bowl segments having a lower outer tapered seat and a plurality of inner camming surfaces which taper downwardly and inwardly, a plurality of slips, means supporting said slips on the bowl segments and allowing relative axial movement between the slips and the bowl segments, said slips each having an inner surface of string engaging teeth and a plurality of outer camming surfaces, said camming surfaces of said slips having at least one portion which tapers downwardly and inwardly at a very slight angle with respect to the vertical axis of the unit and the remaining surfaces which taper downwardly and inwardly at a substantially larger angle with respect to the vertical axis of the unit, and a packing assembly positioned above said slips, said packing assembly being actuated to set position by the downward movement of said bowl segments whereby the setting forces on the packing assembly are limited by the seating of the bowl segments.

2. A wellhead hanger according to claim 1 wherein each of said camming surfaces of said slips is a compound taper including a lower portion which tapers downwardly and inwardly at a very slight angle with respect to the vertical axis of the unit and an upper portion which tapers downwardly and inwardly at a substantially larger angle with respect to the vertical axis of the unit.

3. A wellhead hanger according to claim 2 wherein the inner most portions of the camming surfaces of said bowl segments initially engages said slight angle taper on said slip camming surfaces to provide the initial engagement of said engaging teeth with a string to be supported and subsequentially the tapered portions of said bowl segments engage the larger tapered portions of said slip camming surfaces to provide the support for the string.

4. A wellhead hanger according to claim 1 including a finger on the lower portion of each of said bowl segments extending downwardly and inwardly and adapted to engage said slight angle portions of said slip camming surfaces to provide the initial slip engagement with the string positioned within the slips.

5. A wellhead hanger according to claim 4 wherein said finger is at least slightly resilient so that it urges the slip it engages inward into gripping engagement with the string within the slips but does not provide substantial resistance to the relative movement of the bowl segments and the slips.

6. A wellhead hanger comprising a bowl structure having a plurality of segments, means connecting said bowl segments into a bowl ring, said bowl ring having a lower outer tapered seat and an inner tapered camming surface, a plurality of slips, said slips being positioned within said bowl ring, said slips each having inner surface of string engaging teeth and a first outer tapered camming surface, said slips also having at least one second tapered camming surface which has a shallower angle with respect to the axis of the bowl ring than said first camming surface, means on said bowl ring for initially engaging said second tapered camming surface of said slips prior to the engagement of the bowl camming surfaces with said first slip camming surfaces, and a sealing assembly supported from said bowl structure and sealing between the string supported by said slips and the housing on which said bowl structure is landed, said sealing assembly being independent of the relative movement between said slips and said bowl structure.

* * * * *